US007494709B2

(12) United States Patent
Davis

(10) Patent No.: US 7,494,709 B2
(45) Date of Patent: Feb. 24, 2009

(54) LOW WICK CONTINUOUS FILAMENT POLYESTER YARN

(75) Inventor: John Edward Davis, Salisbury, NC (US)

(73) Assignee: Performance Fibers Operations, Inc., Richmond, VA (US)

( * ) Notice: Subject to any disclaimer, the term of this patent is extended or adjusted under 35 U.S.C. 154(b) by 157 days.

(21) Appl. No.: 10/591,513

(22) PCT Filed: Mar. 18, 2005

(86) PCT No.: PCT/US2005/008989

§ 371 (c)(1),
(2), (4) Date: Sep. 1, 2006

(87) PCT Pub. No.: WO2005/093140

PCT Pub. Date: Oct. 6, 2005

(65) Prior Publication Data

US 2007/0125059 A1 Jun. 7, 2007

(51) Int. Cl.
*D02G 3/00* (2006.01)

(52) U.S. Cl. ..... 428/364; 428/395; 428/375; 442/82; 442/92

(58) Field of Classification Search ..... 428/364, 428/395, 375; 442/92, 181, 93, 94, 98, 82
See application file for complete search history.

(56) References Cited

U.S. PATENT DOCUMENTS

| | | | | |
|---|---|---|---|---|
| 5,116,682 | A * | 5/1992 | Chakravarti et al. | 428/395 |
| 6,383,633 | B1 * | 5/2002 | Allewaert et al. | 428/375 |
| 6,536,804 | B1 | 3/2003 | Dunsmore et al. | |
| 6,630,087 | B1 * | 10/2003 | Hancock et al. | 264/103 |
| 6,766,817 | B2 | 7/2004 | da Silva | |
| 6,918,404 | B2 | 7/2005 | da Silva | |
| 7,012,033 | B2 * | 3/2006 | Hayes et al. | 442/93 |
| 7,066,586 | B2 | 6/2006 | da Silva | |
| 7,244,398 | B2 | 7/2007 | Kotary et al. | |
| 7,285,255 | B2 | 10/2007 | Kadlec et al. | |
| 2003/0175514 | A1 | 9/2003 | Hancock | |
| 2008/0015531 | A1 | 1/2008 | Hird et al. | |

FOREIGN PATENT DOCUMENTS

| | | |
|---|---|---|
| EP | 05731588.9 | 8/2008 |
| WO | 93/02235 | 2/1993 |
| WO | 00/32854 | 6/2000 |

* cited by examiner

*Primary Examiner*—N. Edwards
(74) *Attorney, Agent, or Firm*—Morgan, Lewis & Bockius LLP; Sharon B. McCullen; Louis W. Beardell, Jr.

(57) ABSTRACT

The present invention teaches a filament yarn that has low wicking, i.e., less than or equal to about 6 mm; has a contact angle of greater than or equal to about 65° but less than about 90° according to the straw method; and a static voltage of +/−400 volts (between −400 to +400 volts). Such yarns are traditionally employed in weaving signs, banners, awning, tents and other products where moisture resistant yarn is important. The yarns can be made into fabrics that possess the same features as the yarn, namely low wicking, and water and oil repellency.

8 Claims, No Drawings

LOW WICK CONTINUOUS FILAMENT POLYESTER YARN

BACKGROUND OF THE INVENTION

1) Field of the Invention

This invention relates to filament yarns that are low wicking. Such yarns are traditionally employed in weaving signs, banners, awning, tents and other products where moisture resistant yarn is important. In particular, filament yarns of the present invention have a wicking characteristic of about 6 mm or less, a contact angle of greater than or equal to about 65° but less than about 90°, and have a static voltage range of +/−400 volts (a voltage between −400 to +400). Such filament yarns are made using an aqueous dispersion of a specific fluorocarbon surfactant, or a mixture of a few specific surfactants, that is used to impart water and oil repellency to synthetic fibers. Known fluorocarbon surfactants that impart water and oil repellency to synthetic fibers are not capable of achieving the wicking angle, contact angle and static voltage mentioned previously.

2) Prior Art

Use of fluorochemical emulsions and specifically fluorocarbon surfactant emulsions to impart oil and water resistance to synthetic fibers is well known. These treatments can be applied in the form of a spin finish to impart moisture resistance in fabric made from the fiber or continuous filament. Its use as a spin finish for carpet fibers, for example, is to impart water and oil repellency to the synthetic fibers. The following prior art illustrate these technologies.

U.S. Pat. No. 6,536,804 to Dunsmore et al. relates to carpet fibers in which a spin finish is applied to the synthetic staple fibers (not continuous filament yarn) for creating a surface on the carpet that is water and oil repellent. As set forth in Examples 15-24 of this patent, fluorochemicals were components of the spin finish.

U.S. Patent Application Publication Number US 2003/0175514 to Hancock et al. discloses a low wicking type material that has use in fabrics, which are water repellent. Specific polymers disclosed are nylons, polyesters and polyolefins. This reference also discloses that a filament has a contact angle greater than or equal to 90° as measured by the method disclosed in the Journal of Colloid and Interface Science, 177, 579-588 (1996). This reference also discloses a filament having a coating thereon and wherein the contact angle of the coated filament is greater than or equal to 90°. The coating (described as the "second longitudinally-extending component of the filament") can be virtually any halogenated polymer as disclosed in Paragraph 29.

Although theses prior art documents disclose fluorochemcial based finishes to polyester yarn that results in moisture resistance, they do not disclose wicking less than about 6 mm inches. For example, Honeywell has a product called WickGard™ Anti-Wick Finish. Honeywell advertises that the fabric wicking performance when WickGard™ Finish is employed on the fabric and cured at 155° C. for 15 minutes, is 6.4 mm maximum. Furthermore, the prior art documents disclose a static voltage operating range greater than 400 volts. Static voltage above +/−400 volts, requires that the yarn be processed in a humid atmosphere employing the addition of static eliminators to the processing equipment, and reducing the processing equipment speed by 30% or more. The polarity of the static voltage depends on the relative position of the yarn and the rubbing surface on the triboelectric series. On the other hand, continuous filament yarns having a static operating range of +/−400 volts permits the continuous filament yarns to be processed into a fabric in virtually any ambient air conditions, without the need of static eliminators in the fiber forming and fabric forming equipment, and because the continuous filament is drier, the processing equipment can be run at faster output.

SUMMARY OF THE INVENTION

The present invention teaches a filament yarn that has low wicking, i.e., less than or equal to about 6 mm; has a contact angle of greater than or equal to about 65° but less than about 90° according to the straw method; and a static voltage of +/−400 volts (between −400 to +400 volts). The preferred yarn is continuous To further illustrate that continuous filament yarns are water repellent, the yarns of the present invention have a contact angle greater than or equal to about 65°, while yarns of the prior art have contact angles less than about 65° or greater than about 90°. Those known low wicking continuous filament yarns commercially available at the present time will not have wicking less than or equal to about 6 mm, a static voltage of +/−400 volts, and a contact angle greater than or equal to about 65°. The contact angle test and evaluation are described by Augustine Scientific at Newbury, Ohio. Like all contact angle tests, the higher the degree, the more non wetting the continuous filament is. However, it is virtually impossible to compare the contact angle determined by, for example, the straw method to the contact angle determined by packed cell method versus the contact angle as measured by the procedure set forth in the Journal of Colloid and Interface Science mentioned previously. Simply stated, these various tests give different results and are not comparable, one to the other.

With these characteristics of the prior art in mind, it is the chief aim of the present invention to have a low wicking continuous filament of less than or equal to about 6 mm, a static voltage of +/−400 volts and a contact angle of at least about 65° but less than about 90° according to the straw method. Heretofore, such a continuous filament has not been known in the prior art.

The sign of the static voltage will depend on the relative position of the type of yarn and the rubbing surface on the triboelectric series. Generally polyester and nylon will be positively charged.

DESCRIPTION OF THE PREFERRED EMBODIMENTS

Thermoplastic polymers useful for making synthetic fibers of this invention include fiber-forming polyesters, poly(alpha)olefins, polyamides and acrylics.

Preferred thermoplastic polymers are polyesters are produced from the reaction of a diacid or diester component comprising at about 65 mole % terephthalic acid or $C_1$-$C_4$ dialkylterephthalate, preferable at least 70 mole %, and a diol component comprising at least about 65 mole % ethylene glycol, preferably at least 70 mole %, more preferably at least 75 mole %, even more preferably at least 95 mole %. It is also preferable that the diacid component is terephthalic acid and the diol component is ethylene glycol. The mole percentage for all the diacid component totals 100 mole %, and the mole percentage of all the diol component totals 100 mole %.

Where the polyester components are modified by one or more diol components other than ethylene glycol, suitable diol components of the described polyesters may be selected from 1,4-cyclohexanedimethanol, 1,2-propanediol, 1,3-propanediol, 1,4-butanediol, 2,2-dimethyl-1,3-propanediol, 1,6-hexanediol, 1,2-cyclohexanediol, 1,4-cyclohexanediol, 1,2-cyclohexanedimethanol and diols containing one or more oxygen atoms in the chain, e.g., diethylene glycol, triethylene glycol, dipropylene glycol, tripropylene glycol or mixtures of these, and the like. In general, these diols contain 2 to 18, preferable 2 to 8 carbon atoms. Cycloaliphatic diols can be employed in their cis or trans configuration or as mixtures of both forms. Preferred modifying diol components are 1,4-cyclohexanedimethanol or diethylene glycol, or a mixture of these.

Where the polyester components are modified by one or more acid components other than terephthalic acid, the suitable acid components (aliphatic, alicyclic, or aromatic dicarboxylic acids) of the linear polyester may be selected, for example, from isophthalic acid, 1,4-cyclohexanedicarboxylic acid, 1,3-cyclohexanedicarboxylic acid, succinic acid, glutaric acid, adipic acid, sebacic acid, 1,12-dodecanedioic acid, 2,6-napthalenedicarboxylic acid, bibenzoic acid, or mixtures of these and the like. In the polymer preparation, it is often preferable to use a functional acid derivative thereof such as the dimethyl, diethyl, or dipropyl ester of the dicarboxylic acid. The anhydrides or acid halides of these acids may also be employed where practical.

Other thermoplastic polymers are poly(alpha)olefins, including the normally solid, homo-, co- and terpolymers of aliphatic mono-1-olefins (alpha olefins) as they are generally recognized in the art. Usually, the monomers employed in making such poly(alpha)olefins contain 2 to 10 carbon atoms per molecule, although higher molecular weight monomers sometimes are used as comonomers. Blends of the polymers and copolymers prepared mechanically or in situ may also be used. Examples of monomers that can be employed in the invention include ethylene, propylene, butene-1, pentene-1, 4-methyl-pentene-1, hexene-1, and octene-1, alone, or in admixture, or in sequential polymerization systems. Examples of preferred thermoplastic poly(alpha)olefin polymers include polyethylene, polypropylene, propylene/ethylene copolymers, polybutylene and blends thereof. Polypropylene is particularly preferred for use in the invention.

Typical polyamides suitable for this invention are nylon 6 and nylon 66.

Processes for preparing the polymers useful in this invention are well known, and the invention is not limited to a polymer made with a particular catalyst or process.

The process of melt spinning the multifilament yarn is well known in the art. Through an extruder the molten polymer is fed under high pressure to the heated housing which accommodates the spinning. The molten polymer is forced through a number of spinning orifices provided in a spinneret. The filaments emerge from the spinneret as a bundle. The filament bundle may pass through a delay zone (heated or unheated) prior to a quench zone, in which the bundle is cooled with air of room temperature, which is blown onto the filaments transverse to the direction of movement of the bundle. The filament bundle is subsequently brought into contact with the finish metering unit in which a suitable lubricant is applied to the filaments of the bundle in the usual way. Then the multifilament bundle arrives at the first of a set of advancing rolls for imparting the correct speed to the yarn bundle. The circumferential speed of the feed roll is determinative of the speed at which the filaments are spun and is therefore referred to as the spinning speed. After the spun multifilament yarn has left the rolls, it is wound into a package. The speed at which the yarn is wound will be approximately equal to the spinning speed. After the yarn has been taken up, it is drawn on a separate machine to the desired ratio. In principle, however, drawing also may be carried out on the spinning machine in a continuous spin-drawing process. In the event of the spin-drawing process known per se being applied a drawing device consisting of one or more driven rolls is to be provided between the first driven roll and the winding bobbin.

In addition to the above raw materials employed for making suitable polymers for the present invention, plastic additives can also be added. Such plastic additives may be antistatic agents, biocides, coloring agents (dyes and pigments), coupling agents, flame retardants, heat stabilizers, light stabilizers, lubricants, plasticizers and mixtures of a plurality of these.

Fluorocarbon based surfactants are amphiphilic materials containing an oleophobic and hydrophobic perfluorinated tail and a hydrophilic head. They are effective to reducing the surface tension of surfaces, since the oleophobic tail bonds to the polymer surface and the molecule orients perpendicular to the surface. A key variable in different fluorocarbon based surfactants is the number of carbon atoms in the perfluorinated tail of the compound. It is generally thought that longer chain ($C_8$) fluorochemical tails give lower surface reduction potentials than shorted chains. In the case of their use as spin finishes for fibers it is important that the fluorochemical gives a high surface coverage so that there are no bare areas along which the water can wick. Although not bound by theory, it is believed that the shorter chains take longer to organize and thus flow better on the polymeric fiber surface.

The aqueous dispersion fluorocarbon chemicals used in the present invention are known by their trade names of Afilan 5248A and Afilan 5284B produced by Clariant. Additionally, trade names Lurol FC-L575 and FC-L790 produced from Goulston are likewise satisfactory. The aqueous dispersion fluorocarbon chemicals mentioned above are suitable for the present invention and provide these properties. Many other aqueous dispersion fluorocarbon chemicals (Mitsubishi Chemical Company (Repearl F89, a perfluoroalkyl polyacrylate copolymer emulsion), 3M (F359, a perfluoroctane based surfactant)) have been tested but have been found to be lacking and do not provide a wicking of less than or equal to about 6 mm, a contact angle (as determined by the straw method) of about 65° or more, and a static voltage of less than or equal to +/−400 volts. Since these are proprietary spin finishes, the detailed differences are not known. It was surprising that there was a difference between the various fluorocarbon based finishes.

The aqueous dispersion fluorocarbon chemicals are applied to the fibers as a spin finish, for example. The aqueous dispersions are prepared to give about 15% by weight solids with the remainder being water. Known processes of applying spin finishes to fibers are suitable for the present invention.

TEST PROCEDURES

Wicking

Wicking is determined by the distance that a dye solution wicks up the vertically suspended yarn. A 0.5 wt-% aqueous dye solution of Palanil Cerise NSL 200 (BASF Corporation) is prepared. A paper clip (0.5 g) is tie to one end of the yarn and suspended into a 50 ml beaker. The dye solution is added to the beaker so that it just covers the knot. After 45 minutes, the yarn is lifted out of the beaker and allowed to dry. The amount of wicking above the knot as indicated by the dye line is measured.

Contact Angle

The contact angle is determined by the straw method, as explained by Augustine Scientific of Newbury, Ohio in bulletin number 404 by Dr. Rulison. The contact angle is the quantitative measure of wet-ability for a solid surface being wetted with a liquid, which ranges from 0 (perfect wetting) to 180° (complete non-wetting). The contact angle using the straw method is measured by using several fibers each having a length of about 7.5 cm, which are laid together. A thin flexible copper wire is looped around the fibers and both ends of the wire are fed through a small piece of tubing (the "straw"). Typically Teflon tubing having a small inner diameter of about 1 mm and a length of roughly 25 mm is employed. The wire is pulled so that the fibers are forced to double over on themselves and enter the tube. Enough fibers are used so that the tube becomes fairly tightly packed with fibers. The fibers are trimmed off evenly at the bottom end of the tube and the wire is removed from the fiber loop that is created at the top end of the tube. The tube containing the fibers is attached to the balance (Krüss Processor Tensiometer K12) for experimentation, using a hook through the fibers or alternative clamping technique. A liquid, n-hexane, is raised until it just touches the fibers. The mass versus time data is collected as the liquid penetrates the sample. This data is used to calculate the contact angle using the Washburn equation.

Static Voltage

The static voltage is measured by running the yarn a half turn around a 6.35 mm diameter ceramic (aluminum oxide) pin at yarn speed of 300 meters per min. with a pretension of about 65 g. The static generated is measured 48 mm from the threadline with a Monroe Electronics static voltmeter. The temperature of the test conditions is 70° F. with a relative humidity of 40%.

THE EXAMPLE

A series of polyester industrial yarns, with different finish types, were compared. All yarns were prepared by applying the spin finish (15% emulsion in water) to the spun yarn and used a spin-draw process. The target final finish on yarn was 0.4 to 0.6 wt-%. The yarn dtex was 1100 with 140 filaments. The yarn had a tenacity of 70 cN/tex, a breaking elongation of 25% and a hot air (177° C., 30 min.) shrinkage of 3.5%. The control (no anti-wicking finish) is a commercial Type 787 (INVISTA, Salisbury N.C., U.S.A.) which used a finish consisting of a blend of a thermally stable polyol ester, ethoxylated non-ionic emulsifiers and a cationic antistatic agent.

TABLE 1

| Sample | Wicking (mm) | Contact Angle Degrees (°) | Static Volts |
|---|---|---|---|
| Type 787 control | 80.8 | 57 | 18 |
| 3M F359 fluorocarbon finish | 7.8 | 61.35 | 72 |
| 3M F359 fluorocarbon (no emulsifiers or antistat) | 2.6 | 69.25 | 2362 |
| Mitsubishi Repearl F89 fluorocarbon | 30.2 | 59.65 | 208 |
| Afilan 5248A | 2.6 | 73.75 | 225 |
| Afilan 5284B | 3.1 | 82.35 | 216 |
| Lurol FC-L565 | 3.3 | 68.4 | 119 |
| Lurol FC-L790 | 5.0 | n.m. | 280 |

n.m.—not measured

Thus it is apparent that there has been provided in accordance with the invention, a continuous filament that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A filament yarn having wicking less than about 6 mm, a static voltage, between −400 to +400 volts, and a water contact angle greater than or equal to about 65°, but less than about 90°.

2. The filament yarn of claim 1, wherein said filament is coated with an aqueous fluorocarbon chemical.

3. The filament yarn of claim 1, wherein said filament yarn is selected from the group of polyesters, poly(alpha)olefins, polyamides and acrylics.

4. The filament yarn of claim 1, further including anti-static agents, biocides, coloring agents (dyes and pigments), coupling agents, flame retardants, heat stabilizers, light stabilizers, lubricants, plasticizers and mixtures of a plurality of these.

5. A fabric comprising woven filament yarn having wicking less than about 6 mm, a static voltage, between −400 to +400 volts, and a water contact angle greater than or equal to about 65°, but less than about 90°.

6. The fabric of claim 5, wherein said filament is coated with an aqueous fluorocarbon chemical.

7. The fabric of claim 6, wherein said filament yarn is selected from the group of polyesters, poly(alpha)olefins, polyamides and acrylics.

8. The fabric of claim 5, used in a sign, banner, awning or tent.

* * * * *